US010914322B1

(12) United States Patent
Marquardt

(10) Patent No.: US 10,914,322 B1
(45) Date of Patent: Feb. 9, 2021

(54) ENERGY SAVING ACCUMULATOR CIRCUIT

(71) Applicant: Steven H. Marquardt, Rhinelander, WI (US)

(72) Inventor: Steven H. Marquardt, Rhinelander, WI (US)

(73) Assignee: Steven H. Marquardt, Rhinelander, WI (US)

( * ) Notice: Subject to any disclaimer, the term of this patent is extended or adjusted under 35 U.S.C. 154(b) by 3 days.

(21) Appl. No.: 16/350,185

(22) Filed: Oct. 9, 2018

Related U.S. Application Data

(63) Continuation-in-part of application No. 15/731,294, filed on May 19, 2017, now Pat. No. 10,550,863.

(60) Provisional application No. 62/392,028, filed on May 19, 2016, provisional application No. 62/606,864, filed on Oct. 10, 2017.

(51) Int. Cl.

| | |
|---|---|
| ***F15B 21/14*** | (2006.01) |
| ***F15B 1/02*** | (2006.01) |
| ***F15B 1/24*** | (2006.01) |
| ***F15B 1/027*** | (2006.01) |

(52) U.S. Cl.
CPC ..... *F15B 1/024* (2013.01); *F15B 1/027* (2013.01); *F15B 1/24* (2013.01)

(58) Field of Classification Search
CPC ..... F15B 1/024; F15B 11/024; F15B 2011/0243; F15B 13/021
USPC ..... 91/436, 437, 438
See application file for complete search history.

(56) References Cited

U.S. PATENT DOCUMENTS

| | | | | |
|---|---|---|---|---|
| 2,001,620 | A | 8/1934 | Levy | |
| 2,147,536 | A | 11/1937 | Levy | |
| 2,385,351 | A * | 9/1945 | Davidsen | B63H 25/28 244/223 |
| 2,813,970 | A | 11/1957 | Martinson | |
| 2,856,222 | A | 10/1958 | Gossett | |
| 3,104,125 | A | 9/1963 | Garlinghouse | |
| 3,436,913 | A | 4/1969 | Muller | |
| 3,476,016 | A | 11/1969 | Dixon | |
| 3,570,244 | A | 3/1971 | Strobel | |
| 3,608,431 | A * | 9/1971 | Pease, III | F15B 11/064 91/361 |
| 3,791,690 | A | 2/1974 | Garlinghouse | |
| 3,956,891 | A | 5/1976 | Karazija | |
| 4,161,135 | A | 7/1979 | Garlinghouse | |
| 4,211,078 | A | 8/1980 | Bass | |
| 4,226,167 | A | 10/1980 | Lew | |
| 4,397,221 | A | 8/1983 | Friesen | |
| 4,633,665 | A | 1/1987 | Buter | |
| 4,635,532 | A | 1/1987 | Tanino | |
| 4,840,111 | A | 6/1989 | Garnjost | |

(Continued)

FOREIGN PATENT DOCUMENTS

DE 102012101120 A1 * 8/2013 ..... F15B 1/024

*Primary Examiner* — Abiy Teka
*Assistant Examiner* — Matthew Wiblin
(74) *Attorney, Agent, or Firm* — Andrus Intellectual Property Law, LLP

(57) ABSTRACT

An improved method and circuitry for fluid power applications that provides energy savings through the sequential recycling of normally exhausted pressure or vacuum by direct transfer and accumulation of exhaust pressure for additional use, including from one end of the actuator to the opposite end or within the actuator itself and for use by other devices in separate systems.

20 Claims, 6 Drawing Sheets

(56) References Cited

U.S. PATENT DOCUMENTS 4,969,562 A 11/1990 Saotome
5,007,544 A 4/1991 Saotome
5,050,380 A 9/1991 Johnsson
5,065,664 A 11/1991 Ohta
5,074,192 A 12/1991 Gheorghita
5,214,997 A 6/1993 Lebret
5,237,916 A 8/1993 Malashenko
5,310,315 A * 5/1994 Lafortune ..... B64C 27/72 416/114
5,370,038 A 12/1994 Poppe
5,415,076 A 5/1995 Krone
5,417,064 A 5/1995 Galuszka
5,452,643 A 9/1995 Smith
5,568,759 A 10/1996 Aardema
5,570,286 A * 10/1996 Margolis ..... B60N 2/501 701/36
5,609,088 A 3/1997 Park
5,611,259 A 3/1997 Nagata
5,749,390 A 5/1998 Ermacora
5,960,695 A 10/1999 Aardema
6,095,028 A 8/2000 Lamas
6,170,383 B1 1/2001 Mauritz
6,267,548 B1 7/2001 Lech
6,327,956 B1 * 12/2001 Rink ..... F15B 11/024 91/28
6,354,790 B1 3/2002 Cummings
6,418,715 B1 7/2002 Huber
6,467,264 B1 10/2002 Stephenson
6,516,766 B2 2/2003 Porter
6,658,842 B2 12/2003 Yamasaki
6,691,604 B1 2/2004 Hajek
6,871,574 B2 3/2005 Barber
7,104,181 B2 9/2006 Bitter
7,219,592 B2 5/2007 Nielsen
7,487,707 B2 2/2009 Pfaff
8,028,613 B2 10/2011 Wrede
8,225,706 B2 7/2012 Vigholm
8,453,762 B2 6/2013 Law
8,549,983 B2 10/2013 Brahmer
8,635,940 B2 1/2014 Goldfarb
8,869,924 B2 10/2014 Kim
9,523,184 B2 12/2016 Kim
9,599,248 B2 3/2017 Goldfarb
9,605,768 B2 3/2017 Goldfarb
9,702,118 B2 * 7/2017 Gorman ..... F15B 21/14
2006/0201321 A1 9/2006 Loedige
2006/0249016 A1 11/2006 Ioka
2010/0193714 A1 * 8/2010 Hankinson ..... F15B 1/265 251/12
2011/0005625 A1 * 1/2011 Goldfarb ..... F15B 13/0402 137/625
2014/0158922 A1 6/2014 Goldfarb
2015/0330527 A1 11/2015 Goldfarb
2015/0354172 A1 * 12/2015 Hijikata ..... F15B 11/024 60/414
2015/0354770 A1 12/2015 Goldfarb
2016/0201813 A1 7/2016 Goldfarb

* cited by examiner

ENERGY SAVING ACCUMULATOR CIRCUIT

CROSS-REFERENCE TO RELATED APPLICATIONS

This application claims the benefit of U.S. Provisional Patent Application No. 62/606,864, filed Oct. 10, 2017, and is a continuation-in-part of U.S. patent application Ser. No. 15/731,294, filed May 19, 2017, which claims the benefit of U.S. Provisional Patent Application No. 62/392,028, filed May 19, 2016.

FIELD

The present disclosure generally relates to systems and methods for producing fluid power and more particularly to systems and methods that increase efficiency in the movement of fluid (including air) and vacuum during their working cycles.

Currently, various hardware and methods are employed in an attempt to increase efficiency with little benefit in actual efficiency gain verses the added cost and complexity of manufacture and maintenance of this hardware and methods.

In the prior Direct Link Circuit application by Steven H. Marquardt, (patent application Ser. No. 15/731,294), an energy saving method (and special circuitry) of fluid power control is proposed using a direct, controllable link between the opposing sides of an actuator and further adding an accumulator to this "Direct Link" to recycle additional "normally" exhausted pressure for additional use.

This application, entitled the Energy Savings Accumulator Circuit (ESAC), is a continuation of the Direct Link Circuit's novel method and offers new subject matter with additional, novel benefits.

BACKGROUND

To offer the best comparison, FIG. 1 shows a conventional circuit diagram with a corresponding operational description. In a conventional pneumatic circuit, the pressurizing fluid is sent to an actuator (such as cylinder 32) through a controlling Main Valve 20 that will pressurize one side 30 of the cylinder 32, while exhausting the fluid from the other side 40 of the cylinder 32. It should be recognized that while a cylinder 32 is the most common actuator and for simplicity will be referred to interchangeably. However, this terminology is non-limiting, whereby other actuators include intensifiers, or rotary and diaphragm transfer pumps, for example.

Likewise, the terms "air" or "fluid" are used interchangeably for simplicity to describe any fluid (i.e., using standard reservoirs and return lines) or gas.

The high and low pressure differential between the two cylinder ends makes the internal Piston 38 move to produce the desired work. To return the Piston 38 to its original starting position for another cycle, the Main Valve 20 shifts and sends pressure to Line 34 while allowing Line 44 to "vent" exhaust at vent 21*b* (or vent 21*a* for the opposing stroke). In a hydraulic circuit, the fluid is returned to a reservoir to be stored and pressurized again by a pump.

In either case, the inventor has recognized that this pressurized fluid (or vacuum) is "dumped" to exhaust without doing further work. This occurs every time the stroke changes direction or, in the case of air pumps, at the exhaust discharge port. There is significant cost for initial pressurization/vacuum creation, as well as forcing the fluid medium through the circuit. This results in "lost" energy that needs to be "created" every time the cylinder cycles.

The inventor has recognized that the prior art does not teach, suggest or imply any attempt to recover significant portions of this wasted energy, and certainly not a majority of this wasted energy (over 50%). Various prior art methods teach the use of a valve(s) to briefly connect the pressurized end of an actuator through a valves(s) body to the opposite end prior to requiring new pressure from the originating source. Moreover, previous attempts to add accumulators to this type of circuit do not provide the sequential "final" exhaust operation required for maximum efficiency and actuator movement prior to requiring additional pressure from the main source.

While these prior art methods do provide some energy savings by pre-filling the opposing circuit leg (less than 25% actual savings), it will be seen that the presented disclosed systems and methods far exceeds this prior art in both cost and energy savings. The prior art methods are also restricted primarily to fluid power cylinders and do not adapt to other styles of actuators such as pumps, diaphragm transfer pumps or intensifiers.

In contrast, the presently disclosed systems and methods recover a significant portion (i.e. even over 50 percent) of the currently wasted energy present in the conventional operation of an actuator during every work cycle or continuous operation (as in pump applications), and further save energy for operations requiring a vacuum.

SUMMARY

Figure 1:
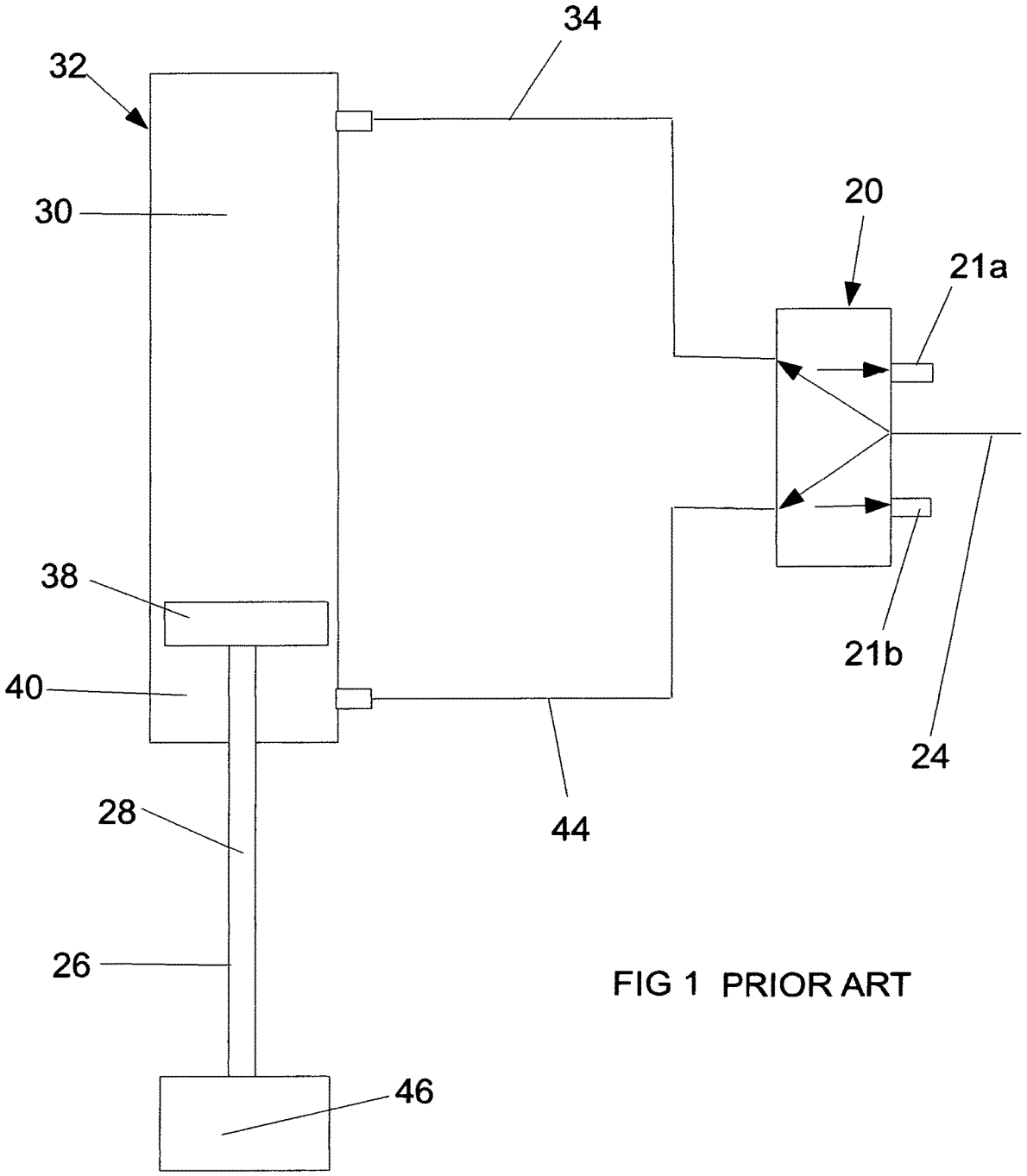
FIG 1 PRIOR ART
FIG. 1 is a Prior art conventional circuit

The present disclosure generally relates to improved methods and circuitry for fluid power applications that provide energy savings through the recycling of normally exhausted pressure by accumulation and recycling of this exhaust pressure.

This new circuit can be established on the supply side of a conventional main valve, as part of the main valve or actuator or incorporated within the actuator itself.

In the Direct Link Circuit application, the Direct Link, Energy Saving Valve and optional Accumulator are located between the main valve and actuator, combined with the main valve and various applications within actuators.

This new method may also be applied to operations requiring the creation and management of negative pressure (vacuum).

DETAILED DESCRIPTION

The use and conservation of negative pressure vacuum in a hydraulic circuit can also be enhanced using these new methods and circuitry. In a vacuum application, the inventor has recognized that significant energy is used to create this vacuum. This energy is lost completely when the vacuum chamber is "un-sealed" and must be created "new" for the next cycle. Significant operating time is also lost waiting for the air/fluid/vacuum to "fill" and "empty" from both sides of the circuit.

The inventor has identified that because a pressure differential always exists between the two sides of an actuator during operation, there is an opportunity to recycle this differential prior to it being exhausted or returned to a reservoir.

The Energy Saving Accumulator Circuit (ESAC) of the present disclosure provides a means to save a significant portion of the pressure in the exiting exhaust by providing an accumulator 60 (FIGS. 2, 3, 4) for 'high' pressure exhaust storage. This pressure is then directed back into the operating circuit at the correct time in the cycle for maximum efficiency.

The ESAC further provides sequential operation that vents the "unusable" lower pressure remaining within the actuator 60 to provide additional actuator movement prior to requiring additional, 'new' pressure from the main supply. In the same manner, negative pressure can be "saved" and accumulated/shared for the next vacuum cycle.

In the ESAC shown in FIGS. 2-6, the accumulator(s) 60, storage valve 36 and flow control valve 26 are connected on the supply side, incorporated into the main valve 20 or actuator 56, for economy and convenience.

Figure 4:
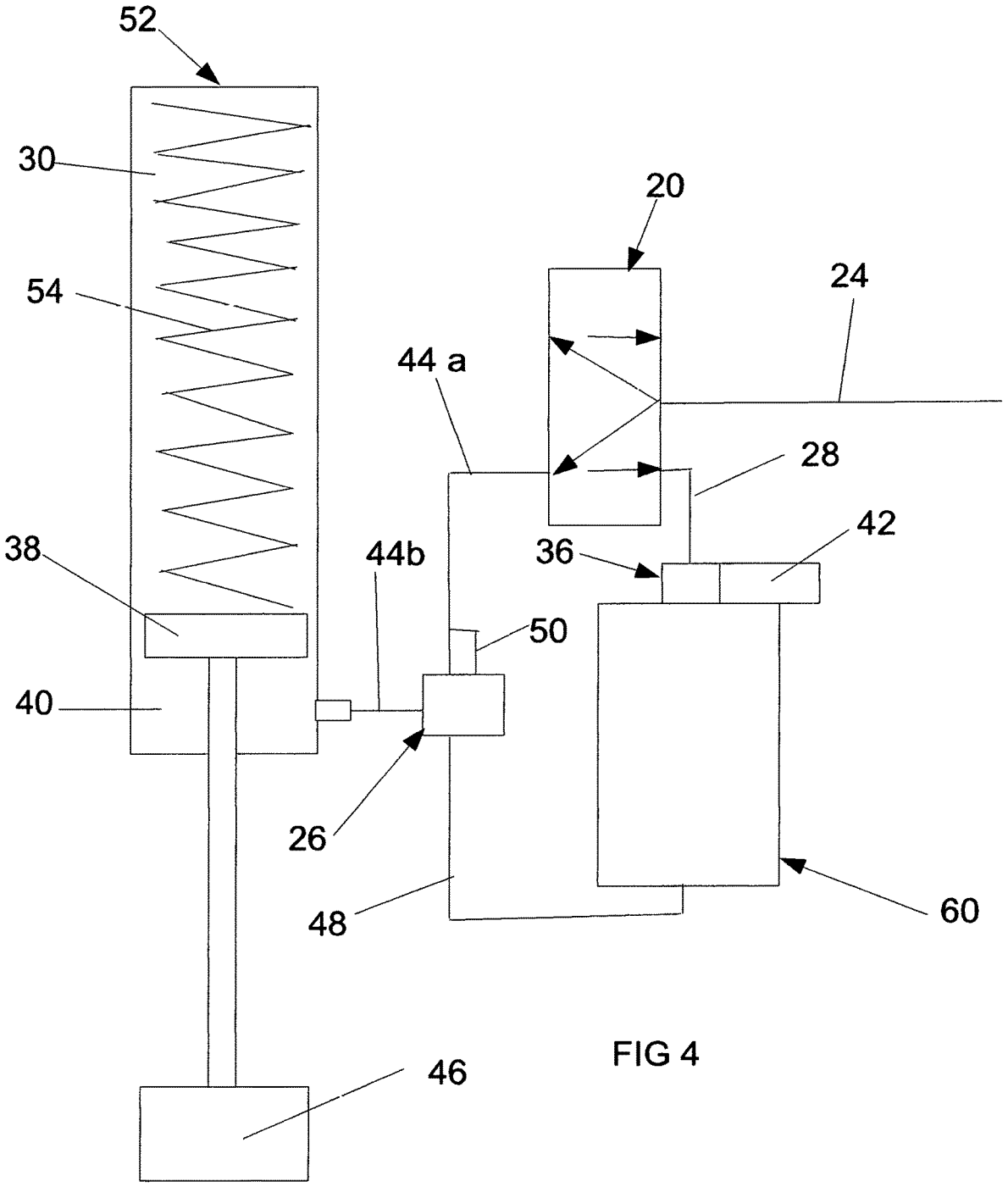
FIG. 4 is a single acting cylinder with another embodiment of ESAC according to the present disclosure

The ESAC further may contain one or more accumulators 60, and the accumulator(s) 60 may also be used to power one FIG. 4 or both ends of the actuator.

The ESAC may also be a single valve body (with an incorporated or directly attached accumulator) with the storage valve 36 and flow control valve 26 functions contained therein. (see FIG. 5)

Figure 2:
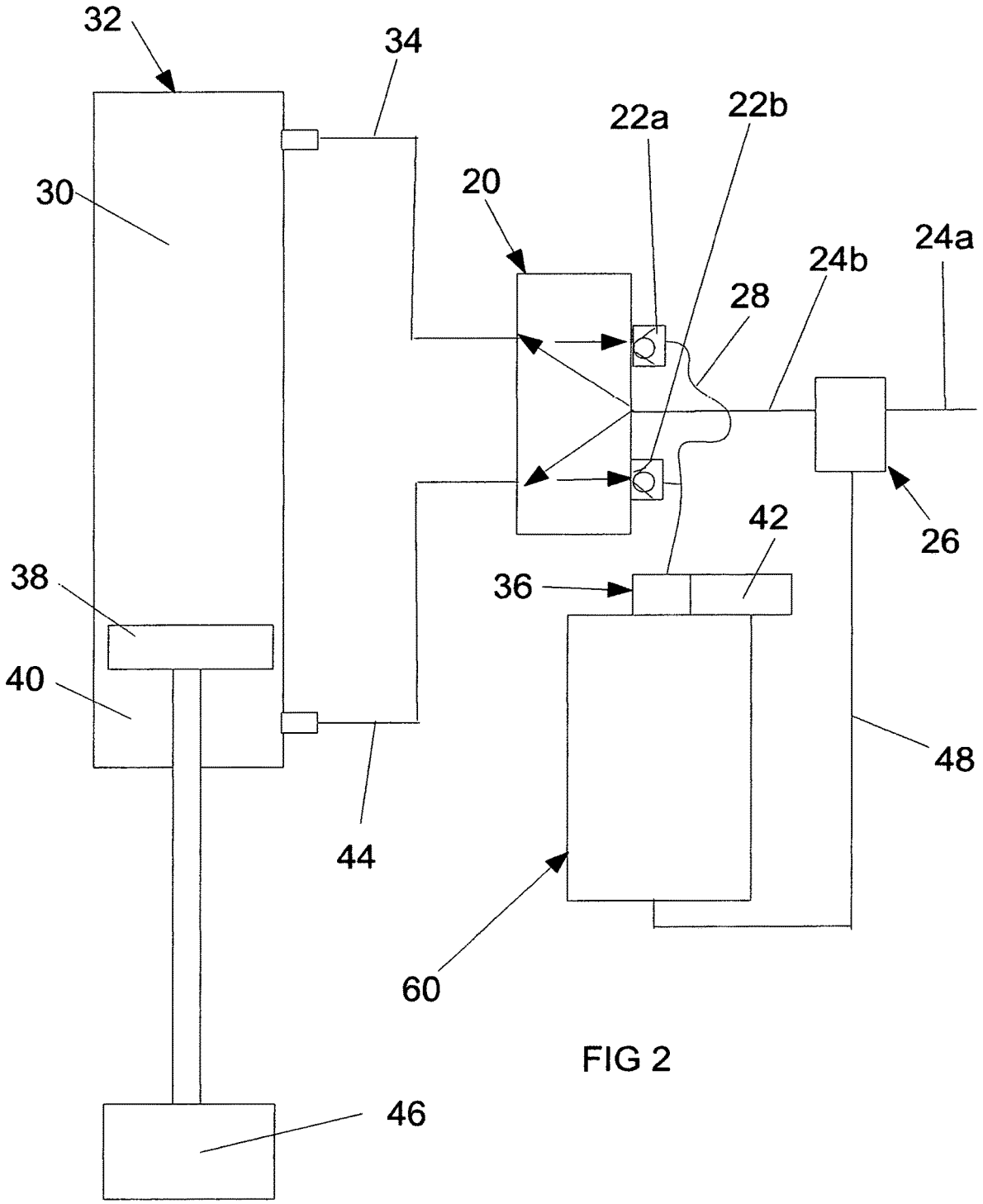
FIG. 2 is a double acting cylinder 22 with the Energy Saving Accumulator Circuit (ESAC) of the present disclosure

Returning to the embodiment of FIG. 2, an ESAC with a single Accumulator 60 is shown that collects exhaust pressure from both extend and retract cycles. The main valve 20 exhaust ports (shown with optional check valves 22*a* 22*b*) are connected to the Storage Valve 36 by conventional air or fluid line 28. When the main valve 20 shifts in either direction, the high pressure exhaust flows through line 28 and storage valve 36 to the accumulator 60. The fluid then travels onward to the release valve 26 until a "set pressure" is reached within the Accumulator 60.

The storage valve 36 blocks any pressure from leaving through the attached vent 42 (normally closed) during this time frame by providing an incorporated pressure set point or timing function (which may be adjustable).

The accumulator 60 is connected by line 48 to release valve 26 located on the main supply line 24. In certain embodiments, the release valve 26 may also be directly connected to the main valve 20 (not shown).

The release valve 26 has a control function that allows it to block the incoming pressure from the main supply line 24*a* when main valve 20 is first shifted in either direction. The control function may be initiated and controlled by standard control methods such as pressure, lack of pressure, pilot, flow or electronic signal and solenoid, for example. The control function forces the release valve 26 to close the main supply line 24*a*, while simultaneously opening line 48 to the accumulator 60, to provide access to recycled pressure.

The ESAC also provides a method and means to fill the accumulator 60 while at the same time also directly pressurizing the side of the circuit requiring pressure. High pressure "exhaust" which in conventional circuits would be normally exhausted) is now routed to accumulator 60 using line 28 and back to the main valve 20 (using line 34 or line 44, depending on cycle). The high pressure stored and supplied to the accumulator 60 flows through line 48, release valve 26 and main supply line 24*b* to the main valve 20 for use with the cylinder 32 to power the extend or retract cycle, depending on main valve 20 position.

When the high pressure exhaust drops below the pressure set point (or other controlled function), the storage valve 36 shifts, closing the accumulator 60 and sending the remaining, "Low" exhaust pressure in the cylinder 32, out the connected vent 42. The vent 42 only allows low pressure from the main valve 20 circuit to the cylinder 32 (lines 33 and 44, and cylinder 22) to drain. Stored pressure is maintained within the Accumulator 60 for continued use.

The ESAC thereby further provides a "Sequential Operation" method to "Drain" the un-usable, 'Low' pressure remaining within the cylinder 32 and allow additional "work" to be performed using the "High" pressure "saved' within the Accumulator 60 Prior to requiring new pressure. Venting the un-usable low pressure from the original high pressure end creates a new pressure differential. High pressure is now in accumulator 60, line 34 or 44 and opposite side of cylinder 36, providing additional actuator work (in contrast to systems known in the art).

The release valve 26, storage valve 36 and vent 42 provides this Sequential Operation method to reuse the existing pressure within the accumulator 60 prior to accessing the main supply line 24 for additional pressure. When the control function ends, the release valve 26 re-opens the main supply line 24*a* and closes line 48 to accumulator 60, providing additional "new" pressure to complete the stroke if necessary.

Through research and experimentation, the inventor has recognized that in many cases there will be enough volume of stored pressure within the accumulator 60 to complete the stroke entirely from recycled pressure, especially if it is an "unloaded" return stroke. This allows one half of the operational cycle to be performed entirely from recycled air for significant energy savings (often over 50%)

It should be noted that some "residual" pressure will remain in the accumulator 60 depending on how quickly the main supply line 24*a* pressure is activated, based in part on operational speed desired and load. This will leave some "residual" pressure stored in the Accumulator 60 prior to normal filling from exhaust pressure. This remaining, "residual" pressure, "pre-loads" the accumulator 60 for the next cycle allowing it to store pressure at a higher, more efficient "final" pressure when it is again loaded from normal cylinder exhaust.

The ESAC thereby provides the system and method to recover "High" pressure from the conventional exhaust stream from one side of an actuator for re-use by the opposing actuator side by incorporating a Sequential Operation method. In particular, this includes venting of "low" exhaust pressure, and circuitry in the form of incorporated valves and an accumulator, for example, to provide significant efficiency gains in any fluid power circuit. This method of storing exhaust pressure and re-cycling it back into the operating sequence (on either or both ends of the actuator) prior to requiring new pressure from the main line, provides significant energy savings (often over 50%) that are not achievable with prior art methods.

It should be noted that any of the valves described herein may be adjustable and initiated and controlled by pilot pressure, internal pressure, solenoid, spring, a timing function, lack of pressure or other conventional means. A conventional electronic system with a programmable logic controller and solenoid valves may also be used for system control.

Figure 5:
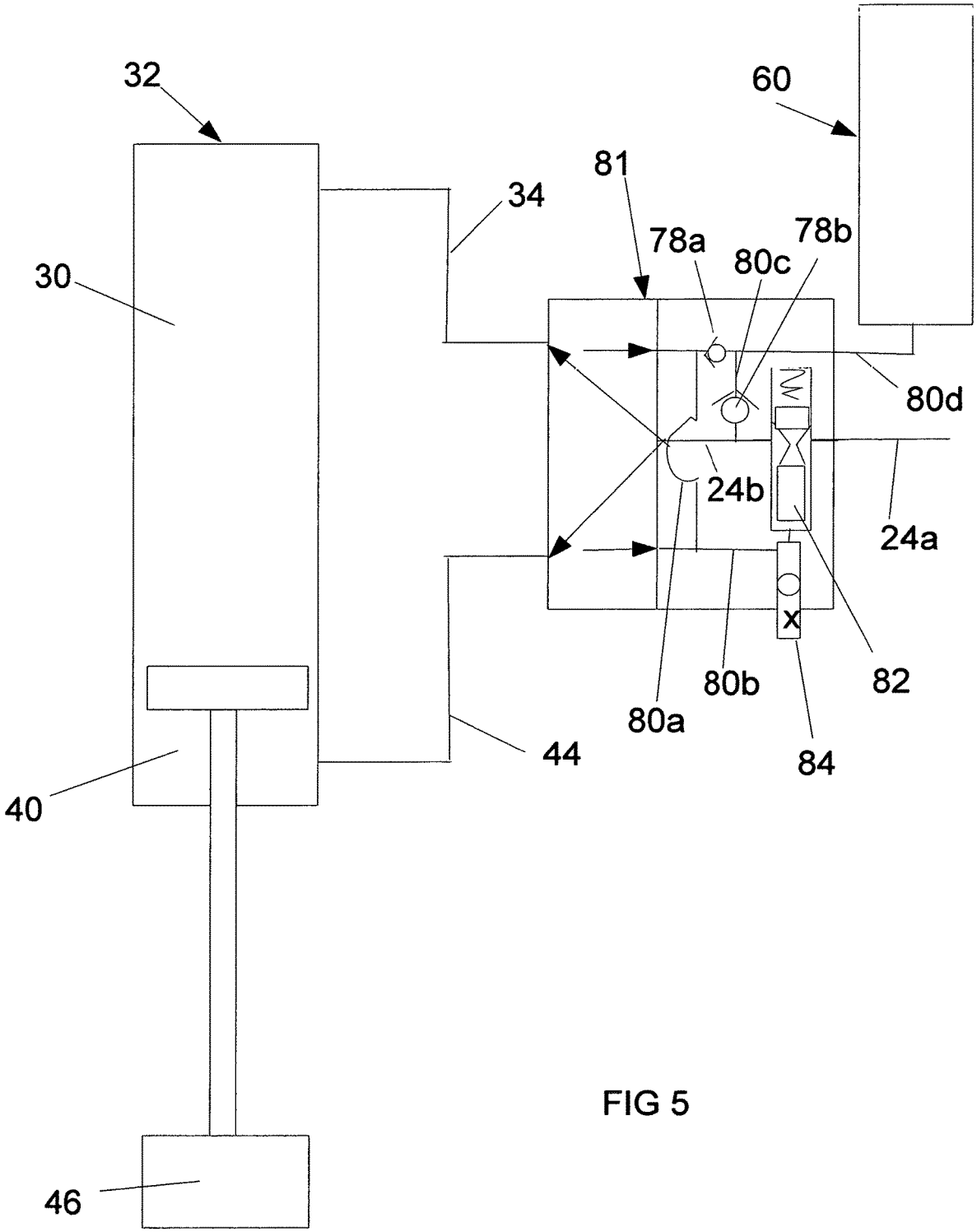
FIG. 5 is an embodiment in which the ESAC is incorporated into a main valve

As shown in FIG. 5, the entire ESAC may be further be incorporated into the supply side of the Main Valve 20, including the accumulator (not shown), or with the accumulator being external.

Figure 3:
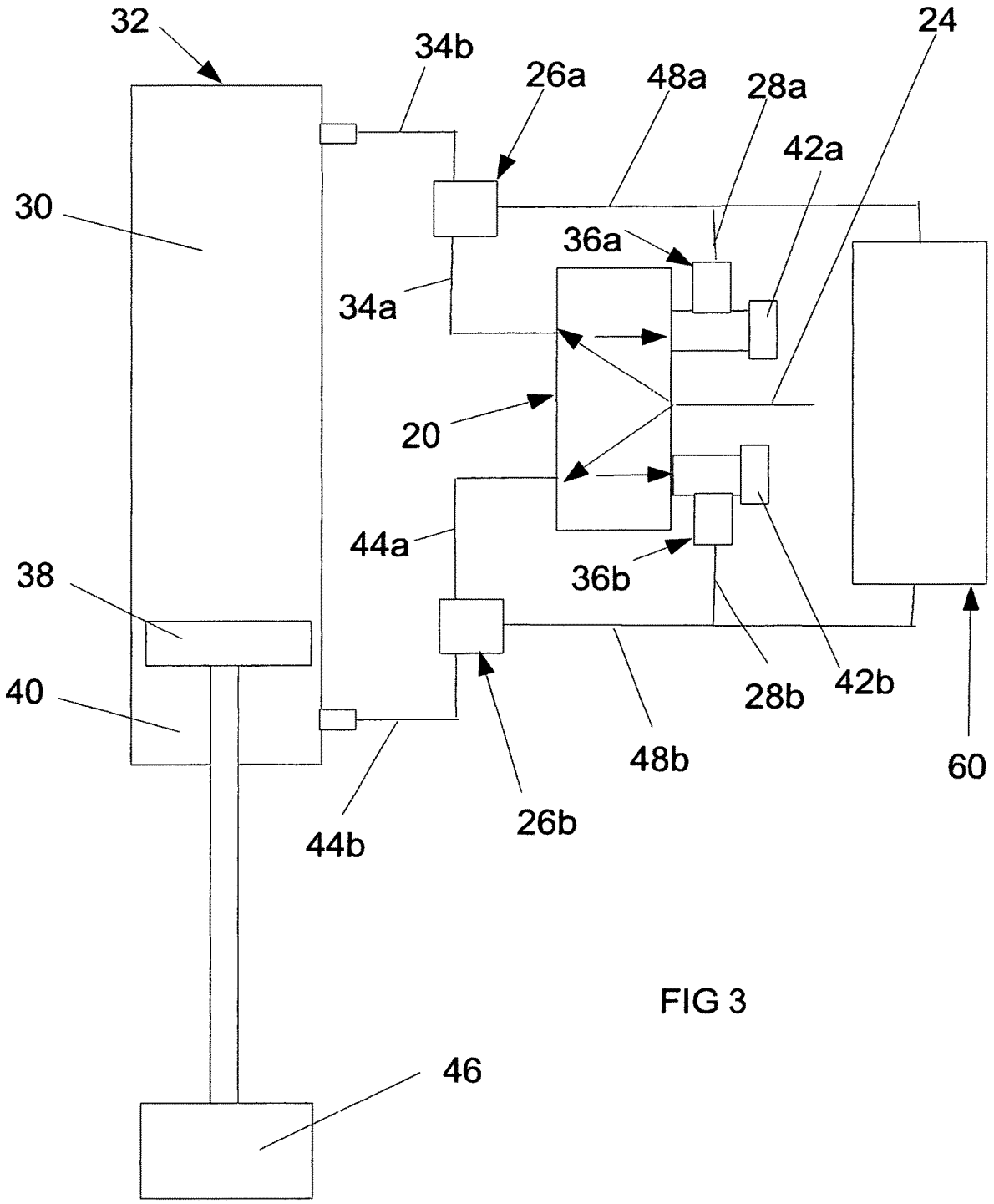
FIG. 3 is the ESAC with separate flow control valves

Another alternate configuration of the ESAC is shown in FIG. 3, which contains two storage valves 36*a*, 36*b* and two release valves 26*a*, 26*b* with a single accumulator 60. Providing two storage valves 36*a*, 36*b* allows individual adjustment of the exhaust saving functions for control of each side of cylinder 32 operation. The two storage valves 36*a*, 36*b* permit initial, high pressure, exhaust to pass to the accumulator 60 through lines 28*a*, 28*b* and then vents the remaining low pressure at a set point through vents 42*a*, 42*b*.

It should be noted that this "venting" of the low pressure exhaust empties only the side of the circuit that would normally empty (i.e. be wasted as exhaust) during the cycle. High pressure is still stored within the accumulator 60. The two storage valves 36*a*, 36*b* may also contain check valves (not shown) to prevent reverse flow. Likewise, any storage valve 36 may also contain pressure relief functions and/or lockouts for maintenance and safety. Providing two release valves 26*a*, 26*b* further provides for individual adjustment of the "release" functions on each side of operation.

Another aspect of this configuration (shown in FIG. 3) is the connecting of the accumulator 60 to release valves 26*a*, 26*b* located between the main valve 20 and the cylinder 32 ends which allows individual adjustment for each side of the actuator. The two release valves 26*a*, 26*b* are connected to the Accumulator 60 by lines 48*a*, 48*b*, as shown. Once again, release valves 26*a*, 26*b* provide the ability to close line 34*a* or 44*a* while opening the correct Line 48*a* or 48*b*, allowing the accumulator 60 pressure to energize the cylinder 32 prior to using main supply line 24 pressure.

The control function can be initiated and controlled by pilot/pressure signals from Line 34*a* or 44*a* (for example, located within each release valve 26*a*, 26*b*) when the main valve 20 is initially shifted (not shown). Once again, initiating and controlling the control function may be provided by conventional means such as pilot signals, pressure (or lack of), electronic controls, limit switches, etc. The timing of the control functions of the release valves 26*a*, 26*b* may be adjustable to compensate for cylinder load, pressure or other variables in each application.

Another alternate configuration (shown in FIG. 4) is a single acting (i.e., spring extended) cylinder 52 shown with the pressurized retract function being initially energized by the stored pressure within the accumulator 60 from the previous stroke. In this example, the ESAC can be established on one side only of any single acting cylinder 52 (spring extend or retract), or with actuators returned by gravity or load by a slight change in the Sequential operation function. The pressure to be saved exits from the conventional exhaust port on the supply side of the main valve 20 when main valve 20 is shifted and then flows to the accumulator 60 through line 28 and attached storage valve 36.

For re-use, the stored pressure (from accumulator 60) is sent through line 48 to the release valve 26 and then to line 44*b* when release valve 26 is activated. Release valve 26 temporarily shuts off line 44*a* to the main valve 20 and opens line 48 to supply the initial pressure from the accumulator 60 to the cylinder 52. The control function of release valve 26 then closes line 48 and opens line 44*a* to main valve 20 to vent remaining low pressure for full retraction of cylinder 52. Exhaust pressure is recovered once again by the accumulator 60 when the main valve 20 shifts, opening line 28 to storage valve 36 to the accumulator 60.

In this example, the ESAC is used to save energy when used with any single acting spring extend or return) type cylinder, allowing the exhaust to be saved and re-used at the same end of the cylinder for the next stroke. It should be noted that any single acting or "load returned" actuator may also function by interrupting the main supply line 24 (instead of lines 44*a*, 44*b*) as shown in previous examples.

As seen in FIG. 5, the ESAC may further be combined with the main valve body to form a single combination valve 81. The high pressure exhaust is collected (using connecting line 80*a*) when combination valve 81 shifts via conventional methods (not shown). The high pressure exhaust is then sent to the accumulator 60 through connecting line 80*d* and check valve 78*a*. The high pressure exhaust also travels through connecting line 80*b* and closes normally open valve 82, which stops the flow of "new" pressure from supply line 24*a*. This high pressure exhaust also flows through connecting line 80*c* and check valve 78*b* to supply line 24*b*.

At this point, the opposite end of the actuator is now supplied by the high pressure exhaust from the original high pressure end of cylinder 32. As the high pressure exhaust is transferred from the accumulator 60 and original high pressure end of cylinder 32, the pressure drops and triggers a low pressure exhaust valve 84 to open the circuit. The low pressure exhaust valve 84 is adjustable and normally closed when high pressure is present.

At a set point, it will open and vent the remaining lower pressure which allows Valve 82 to re-open Supply Line 24*a* for "pass through" operation with new supply pressure if needed. High pressure that has been collected by accumulator 60 is prevented from reverse flow by check valves 78*a*, 78*b*.

It will be noted that the novel circuits and methods discussed herein can be established in many ways and forms including, but not limited to, multiple position and sequence valves.

Further embodiments according to the present disclosure incorporate an ESAC that is externally used with transfer pumps, intensifiers and other pressure source actuators, specifically by providing a means to control the ESAC from the SUPPLY side of the main valve or actuator.

Figure 6:
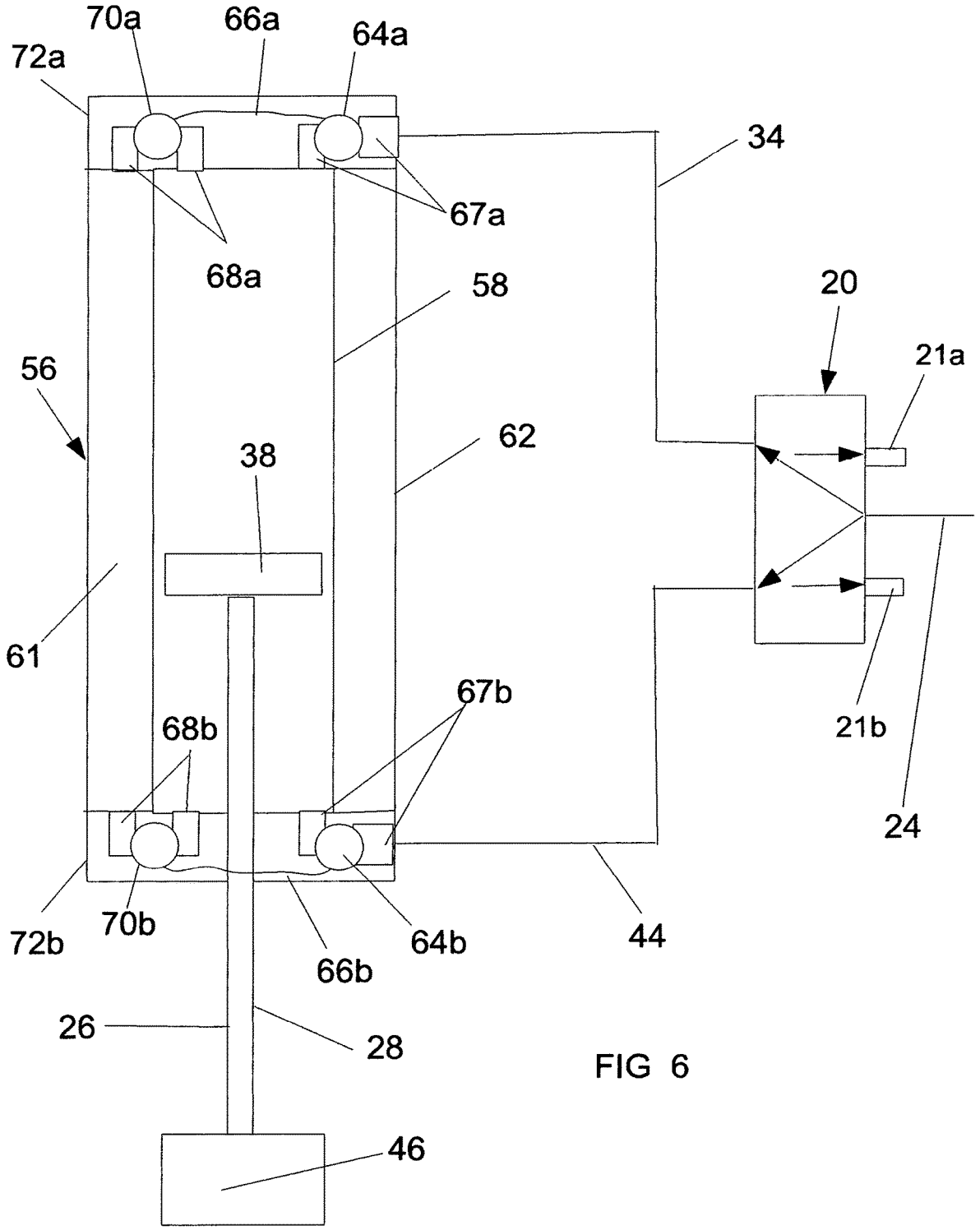
FIG. 6 is an embodiment having a double walled actuator with an internal ESAC

As shown in FIG. 6, the ESAC can also be directly incorporated into any actuator for significant cost savings and both the ESAC and the accumulator can be incorporated directly into the actuator. FIG. 6 details a double walled actuator 56 with the inner cylinder 58 performing the normal cylinder functions of extend and retract and the volume between the inner cylinder 58 and outer diameter 62 acting as an accumulator 61 for storing pressure. The inner cylinder 58 and outer diameter 62 are joined by end caps 72*a*, 72*b* that seal and hold both in fixed relationships to each other.

end caps 72*a*, 72*b* further contain dual function valves 70*a*, 70*b* on each end (or one end only in a single acting cylinder application), as well as connecting ports 67*a*, 67*b* for various fluid flow requirements. The dual function valves 70*a*, 70*b* are connected internally to both the inner cylinder 58 and accumulator 61 by passages 68*a*, 68*b*. The dual function valves 70*a*, 70*b* may also be "cartridge" type valves installed internally into ports located in the end caps 72*a*, 72*b*. The dual function valves 70*a*, 70*b* combine both the "storage" of exhaust pressure function as well as the "release" function of the ESAC design (with control function) in one valve.

Pilot passages 66*a*, 66*b* (or external lines) can be used to control the in-flow from the main valve 20 using pilot operated shutoff valves 64*a*, 64*b* located within (as shown) or attached to the end cap (not shown). The main valve 20 contains conventional exhaust vents 21*a*, 21*b* or optional vents may be attached and controlled directly at the end caps 72*a*, 72*b* as part of dual function valves 70*a*, 70*b* or shutoff valves 64*a*, 64*b* operation (not shown). The double walled actuator 56 provides both the control system of the ESAC and the accumulator function, which are both incorporated within the actuator itself for fast and highly efficient operation.

In a similar manner to the double walled actuator system, the ESAC and accumulator may be incorporated into other pressure actuators (i.e., such as transfer pumps, intensifiers, etc.) to provide significant energy savings by recycling previously wasted exhaust pressure.

These new control and incorporation methods provide additional energy savings, while also offering many unique benefits such as low profile installation, lower system cost, faster circuit operation, and ease of maintenance.

The presently disclosed Energy Saving Accumulator Circuit is very economical to manufacture using inexpensive control valves and conventional accumulators. The volume of the accumulator can be sized for optimal circuit operation while also locating it away from the actual cylinder operation when space concerns are important. Connecting the accumulator and control valves on the supply side of the main valve (at the normal exhaust port locations) presents easy installation, retrofitting, and maintenance. Moreover, initial control of the ESAC can be activated by the same control signal that operates the main valve also providing simple installation and troubleshooting.

Any ESAC control valves may also be provided with independent adjustments for controlling circuit speed related to load, direction of travel and other factors. The ESAC further may be used to activate (or store pressure from) one or both sides of the cylinder stroke and further used to save energy with any single acting or "load returned" cylinders. This new method of establishing the Energy Saving Accumulator Circuit on the supply side of the main valve or actuator or within the actuator provides a novel way to allow energy savings for actuators in the field of transfer diaphragm) pumps, intensifiers, etc. The ESAC also provides an easy and convenient way to retrofit existing actuators to provide the additional energy savings of the ESAC.

Another benefit of the accumulator gathering "exhaust" pressure (which would normally be lost in conventional circuits) is allowing the use of this stored pressure by other actuators or systems nearby. Additionally, if the accumulated pressure is not needed by the original actuator, it can also be returned to the inlet of the original compressor/pump, which reduces energy costs. The accumulated pressure may also be released to power a turbine generator (or similar device) to generate electricity for additional manner of savings.

In the manner described above, the Energy Saving Accumulator Circuit provides many novel methods and means to conserve the energy normally wasted in the exhaust pressure of a conventional fluid power circuit. The ESAC does this by directing the high pressure contained in conventional exhaust to an accumulator for re-use by the actuator before requiring additional pressure from the main supply.

As part of this novel circuit, remaining, low pressure, exhaust is sequentially vented to allow further actuator operation, once again, prior to requiring additional pressure from the main source. The ESAC provides both the method and means to control this new technology to provide significant energy savings, often a 50% or higher improvement over conventional circuit operation. Often, an entire stroke (such as a return stroke that would normally require additional, new pressure from the main supply) can be completed entirely from the accumulated pressure from the previous stroke. The ESAC can be easily added to existing systems, built into the main valve, or incorporated within many actuators. The accumulator function may also be directly incorporated into actuators as desired or located remotely for space considerations. It should be further noted that those skilled in fluid power may re-configure the various valves and circuitry to accomplish the new method of energy conservation outlined herein.

The new method and the various circuitry logic presented in this application that will significantly improve energy conservation for all fluid power applications.

I claim:

1. A method for conserving energy when moving a piston within a actuator, wherein the actuator has first and second ends that are moveably separated by the piston, wherein fluid entering the first end causes the piston to move towards the second end, wherein the fluid exiting the first end causes the piston to move away from the second end, wherein a main valve controls the fluid entering and exiting the actuator, and wherein the main valve is also operatively coupled to a main source, the method comprising:

fluidly connecting an energy saving valve (ESV) between an accumulator and the actuator, wherein the ESV is configured to:

simultaneously direct the fluid from the second end of the actuator to the accumulator and to the first end of the actuator to move the piston towards the second end; and exhaust, after directing the fluid to the accumulator and the first end of the actuator, the fluid remaining within the second end of the actuator;

whereby energy is conserved by reusing the fluid collected within the accumulator to move the piston.

2. The method according to claim 1, wherein the first and second ends of the actuator each have lines communicating the fluid therewith, respectively.

3. The method according to claim 1, wherein the ESV is fluidly connected between the main source and the main valve such that the main valve receives the fluid from both the main source and the accumulator.

4. The method according to claim 3, wherein the ESV is further configured to block communication between the main source and the main valve while the fluid collected within the accumulator flows to the main valve.

5. The method according to claim 3, wherein the main valve has an inlet, and wherein fluid from both the accumulator and the main source is received by the main valve at the inlet.

6. The method according to claim 1, further comprising fluidly connecting the accumulator to a vent such that the fluid collected within the accumulator does not exceed a pressure limit.

7. The method according to claim 1, wherein the ESV comprises two ESVs that communicate fluid between the accumulator and the first and second ends of the actuator, respectively.

8. The method according to claim 7, wherein the accumulator is shared and fluidly connected to both of the two ESVs.

9. The method according to claim 1, wherein the actuator further comprises a biasing device that biases the piston towards the first end of the actuator.

10. A method according to claim 1, wherein the accumulator is provided within the actuator.

11. The method according to claim 1, wherein the accumulator is fluidly coupled to both the first and second ends of the actuator.

12. The method according to claim 1, wherein the ESV is further configured to, after exhausting the remaining fluid from the second end of the actuator, direct additional fluid from the main source to the first end of the actuator to further move the piston towards the second end.

13. A system for conserving energy when moving a piston within a actuator, wherein the actuator has first and second ends that are moveably separated by the piston, wherein fluid entering the first end causes the piston to move towards the second end, wherein the fluid entering the second end causes the piston to move towards the first end, wherein a main valve controls the fluid entering and exiting the actuator, and wherein the main valve is also operatively coupled to a main source, the system comprising:

an energy saving valve (ESV) fluidly coupled to the first and second ends of the actuator, wherein the ESV is configured to:

direct the fluid from the second end of the actuator to the first end of the actuator to move the piston towards the second end; and exhaust, after directing the fluid to an accumulator and the first end of the actuator, the fluid remaining within the second end of the actuator;

whereby energy is conserved by reusing the fluid from the second end to move the piston.

14. The system according to claim 13, wherein the ESV is configured to simultaneously direct the fluid from the second end of the actuator to the accumulator and the first end of the actuator.

15. The system according to claim 13, wherein the ESV is further configured to, after exhausting the remaining fluid from the second end of the actuator, direct additional fluid from the main source to the first end of the actuator to further move the piston towards the second end.

16. The system according to claim 13, wherein the accumulator is provided within the actuator.

17. The system according to claim 13, wherein the ESV is fluidly connected between the main source and the main valve such that the main receives the fluid from both the main source and the accumulator.

18. The system according to claim 13, wherein the ESV is further configured to block communication between the main source and the main valve until the fluid collected within the accumulator has been received the main valve.

19. The system according to claim 13, wherein the ESV comprises two ESVs that communicate fluid between the accumulator and the first and second ends of the actuator, respectively.

20. The system according to claim 13, wherein the ESV is further configured to direct the fluid from the first end of the actuator to both the accumulator and the second end of the actuator to move the piston towards the first end and to subsequently exhaust the fluid remaining within the first end of the actuator and that energy is conserved by reusing the fluid from the first end to move the piston.

* * * * *